US006843698B2

(12) United States Patent
Mochizuki et al.

(10) Patent No.: US 6,843,698 B2
(45) Date of Patent: Jan. 18, 2005

(54) ARC TUBE AND METHOD OF PRODUCING THE SAME

(75) Inventors: Yoshihiro Mochizuki, Shizuoka (JP); Hiroshi Goto, Shizuoka (JP); Masayuki Umehara, Shizuoka (JP); Kunio Fukai, Shizuoka (JP); Ario Kawaguthi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/426,851

(22) Filed: May 1, 2003

(65) Prior Publication Data

US 2003/0232564 A1 Dec. 18, 2003

(30) Foreign Application Priority Data

May 7, 2002 (JP) ..... P.2002-131107

(51) Int. Cl.[7] ..... H01J 9/00

(52) U.S. Cl. ..... 445/26; 445/43; 313/243; 313/244; 313/623; 313/624; 313/625

(58) Field of Search ..... 313/243–245, 313/623–625; 445/43, 26

(56) References Cited

U.S. PATENT DOCUMENTS 4,254,356 A * 3/1981 Karikas ..... 313/623
5,277,639 A 1/1994 Nagata et al.
6,590,341 B1 * 7/2003 Kitano et al. ..... 313/623
6,661,172 B2 * 12/2003 Kuti et al. ..... 313/624

FOREIGN PATENT DOCUMENTS

JP 63-40354 B2 8/1988

OTHER PUBLICATIONS

TWI, Resistance projection welding, accessed on Mar. 21, 2004, http://www.twi.co.uk/j32k/protected/band_3/kssaw003.html.*

Welding Technology Corporation, Projection Welding, accessed on Mar. 21, 2004, http://www.medar.com/welding_concepts/projectionweld.html.*

Metalforming OnLine , projection welding: what is it?, accessed on Mar. 21, 2004, http://www.metalforming.com/forum/thread.cfm?threadid=498&messages=9.*

* cited by examiner

*Primary Examiner*—Nimeshkumar D. Patel
*Assistant Examiner*—Anthony Perry
(74) *Attorney, Agent, or Firm*—Sughrue Mion, PLLC

(57) ABSTRACT

Before an electrode assembly is inserted into a quartz glass tube, a reinforcement bending process is applied to a metal foil. Even when a vibration load acts on the electrode assembly during the insertion of the electrode assembly into the quartz glass tube, the metal foil is not easily deformed, so that a rod electrode can be prevented from largely swinging together with the metal foil. Consequently, the position of a tip end portion of the rod electrode can be easily recognized by using a camera, whereby the degree of the insertion of the electrode assembly into the quartz glass tube can be correctly adjusted.

8 Claims, 8 Drawing Sheets

72
16
20
18
22
74
74a 116
118a
120
122
118
60a
60
2

116
118a
120
122
118
60a
60
2

116
118
120
122
60a
60
2

116
118
122
120
60a
60
2

ARC TUBE AND METHOD OF PRODUCING THE SAME

BACKGROUND OF THE INVENTION

1. Field of the Invention

The present invention relates to an arc tube which is useful as a light source of a vehicle head lamp or the like, and also to a method of producing such an arc tube.

2. Description of the Related Art

Because of their ability to provide illumination at high intensity, arc tubes are increasingly used today also as light sources of vehicle head lamps and other applications. Usually, an arc tube comprises: an arc tube body which is made of quartz glass, and in which a light emitting tube portion is formed; and a pair of electrode assemblies which are pinch-sealed to the ends of the light emitting tube portion, respectively.

As shown in FIG. 7, in each of electrode assemblies 116, a rod electrode 118 and a lead wire 120 are connected to each other via a metal foil 122. The electrode assembly is pinch-sealed to a quartz glass tube 2 which is to serve as an arc tube body, in a state where a tip end portion 118*a* of the rod electrode 118 is protruded into a discharge space 112.

The pinch seal is performed in the following manner. As shown in the figure, the electrode assembly 116 in the state where the lead wire 120 is held on the assembly is inserted to a predetermined position in the quartz glass tube 2 starting from the tip end portion 118*a* of the rod electrode 118.

In the electrode assembly 116, the rod electrode 118 is held in a cantilevered manner via the metal foil 122 which is thin. When a vibration load due to mechanical vibrations or the like acts on the assembly, therefore, the rod electrode 118 often resonates with the load to largely swing.

The degree of the insertion of the electrode assembly 116 into the quartz glass tube 2 is adjusted while monitoring the position of the tip end portion 118*a* of the rod electrode 118 by a camera 50. When the rod electrode 118 largely swings, however, an image taken by the camera is not clear, so that the position of the tip end portion 118*a* is hardly recognized. As a result, there arises a problem in that the electrode assembly 116 cannot be correctly inserted to the predetermined position in the quartz glass tube 2.

Usually, the lead wire 120 and the metal foil 122 are connected to each other by spot welding. A technique in which spot welding is employed as the process for the connection in order that the current density can be increased to enhance the weld strength has been proposed (see JP-B-63-40354).

In the case where spot welding is employed, however, the metal foil 122 is often bent in an end portion on the side of the lead wire 120 as shown in FIG. 8A. When the electrode assembly 116 in which the metal foil 122 is bent is inserted into a quartz glass, the tip end portion 118*a* of the rod electrode 118 sometimes abuts against an opening end 60*a* of an insertion guide pipe 60 as shown in FIG. 8B. In such a case, there arises a problem in that, as shown in FIG. 8C, the metal foil 122 is flexed so largely that, as shown in FIG. 8D, the electrode assembly 116 is inserted into the quartz glass tube 2 via the insertion guide pipe 60 while maintaining the state where the metal foil 122 is bent.

SUMMARY OF THE INVENTION

The invention has been conducted in view of such circumstances. It is an object of the invention to provide an arc tube in which, in a step of inserting an electrode assembly to a predetermined position in a quartz glass, a failure in the insertion of the electrode assembly can be efficiently suppressed from occurring, and also a method of producing such an arc tube.

In the invention, the object is attained by applying a reinforcement bending process to a metal foil.

The method of producing an arc tube of the invention is a method of producing an arc tube comprising a step of inserting an electrode assembly in which a rod electrode and a lead wire are connected to each other via a metal foil, to a predetermined position in a quartz glass tube starting from a tip end portion of the rod electrode, wherein before the electrode assembly is inserted into the quartz glass tube, a reinforcement bending process is applied to the metal foil.

The term "reinforcement bending process" means a process of forming the shape of a section perpendicular to the longitudinal direction of the metal foil at any position between the rod electrode and the lead wire, into a nonlinear shape. The specific manner of the process is not particularly limited.

The arc tube of the invention is an arc tube having an electrode assembly in which a rod electrode and a lead wire are connected to each other via a metal foil, wherein the lead wire and the metal foil in the electrode assembly are connected to each other by projection welding, and the projection welding is performed in a state where a flat face is formed on a peripheral face of an end portion of the lead wire, a projection is formed at an intermediate position in a longitudinal direction of the flat face, and the metal foil is placed to straddle the projection in the longitudinal direction.

As described above, in the method of producing an arc tube of the invention, before the electrode assembly is inserted into the quartz glass tube, the reinforcement bending process is applied to the metal foil. Therefore, the method can attain the following effects.

When the electrode assembly is to be inserted into the quartz glass, the metal foil has a shape to which the reinforcement bending process has been applied, in place of a flat plate shape. Even when a vibration load acts on the electrode assembly, therefore, the metal foil is not easily deformed, so that the rod electrode can be prevented from largely swinging together with the metal foil. Consequently, the position of a tip end portion of the rod electrode can be easily recognized by using a camera, whereby the degree of the insertion of the electrode assembly into the quartz glass tube can be correctly adjusted.

According to the invention, therefore, in a step of inserting the electrode assembly to a predetermined position in the quartz glass, a failure in the insertion of the electrode assembly can be efficiently suppressed from occurring.

As described above, the specific manner of the "reinforcement bending process" is not particularly limited. When a process of bending the metal foil to form a section perpendicular to a longitudinal direction of the metal foil, into a substantially V-like shape is employed as "reinforcement bending process," the reinforcement bending process can be performed by using a simple apparatus.

In the above configuration, when the lead wire and the metal foil in the electrode assembly are connected to each other by projection welding, it is possible to obtain sufficient weld strength. In this case, when the projection welding is performed in a state where a flat face is formed on a peripheral face of an end portion of the lead wire, a projection is formed at an intermediate position in a longitudinal direction of the flat face, and the metal foil is placed to straddle the projection in the longitudinal direction, the following effects can be attained.

In the middle of the projection welding, the metal foil abuts against the projection to be once bent in an end portion on the side of the lead wire. At a timing when the projection welding is completed, however, the bending of the metal foil is corrected by the flat face which is positioned on both the sides of the projection, whereby the lead wire and the metal foil can be caused to extend in a substantially linear manner. When the electrode assembly is inserted into the quartz glass, therefore, it is possible to prevent the tip end portion of the rod electrode from abutting against an opening end of an insertion guide pipe. As a result, in an electrode assembly inserting step, a failure in the insertion of the electrode assembly can be more efficiently suppressed from occurring.

DETAILED DESCRIPTION OF THE INVENTION

Hereinafter, an embodiment of the invention will be described with reference to the accompanying drawings.

Figure 1:
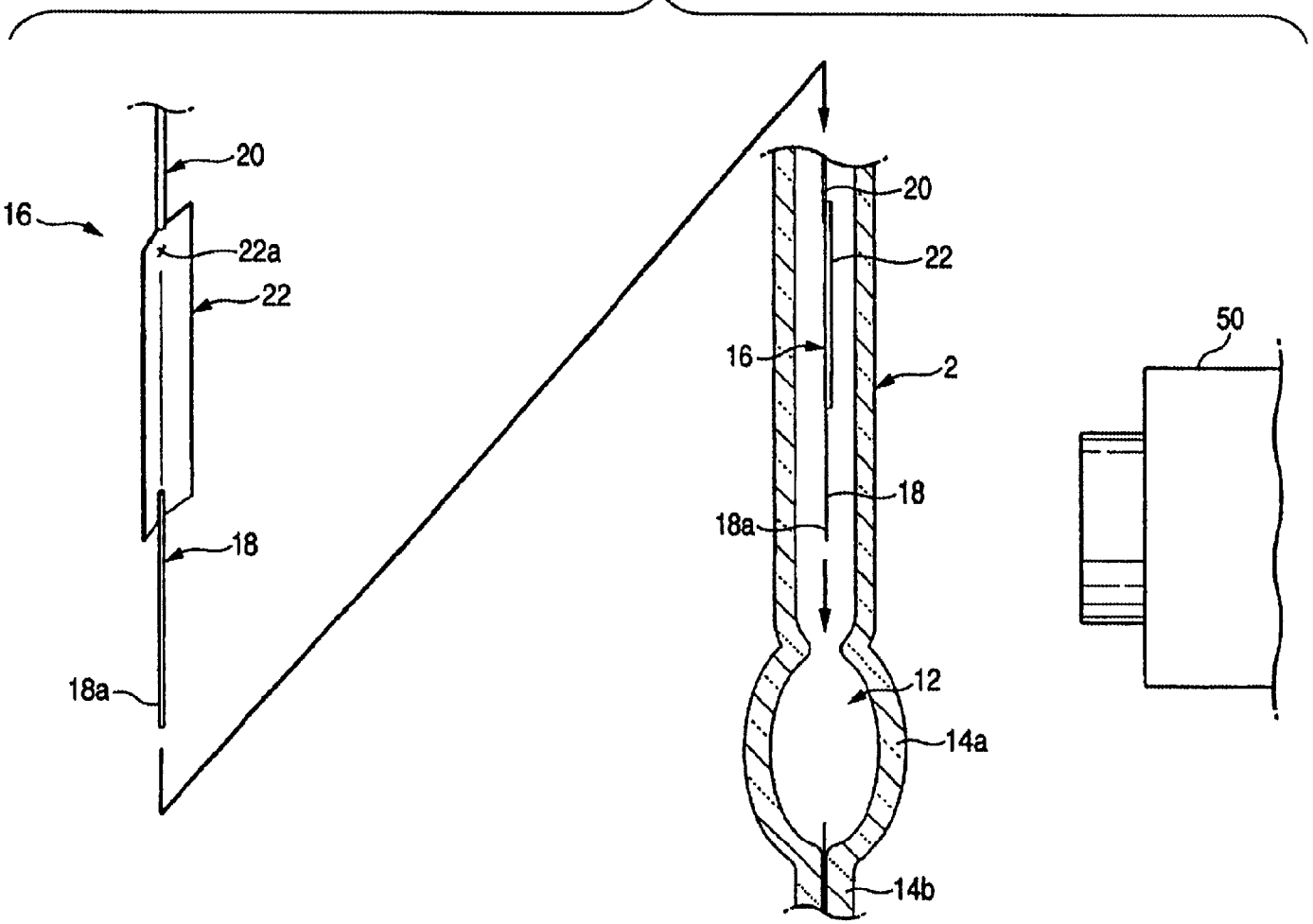
FIG. 1 is a perspective view showing an electrode assembly inserting step in the method of producing an arc tube of an embodiment of the invention.
Figure 2:
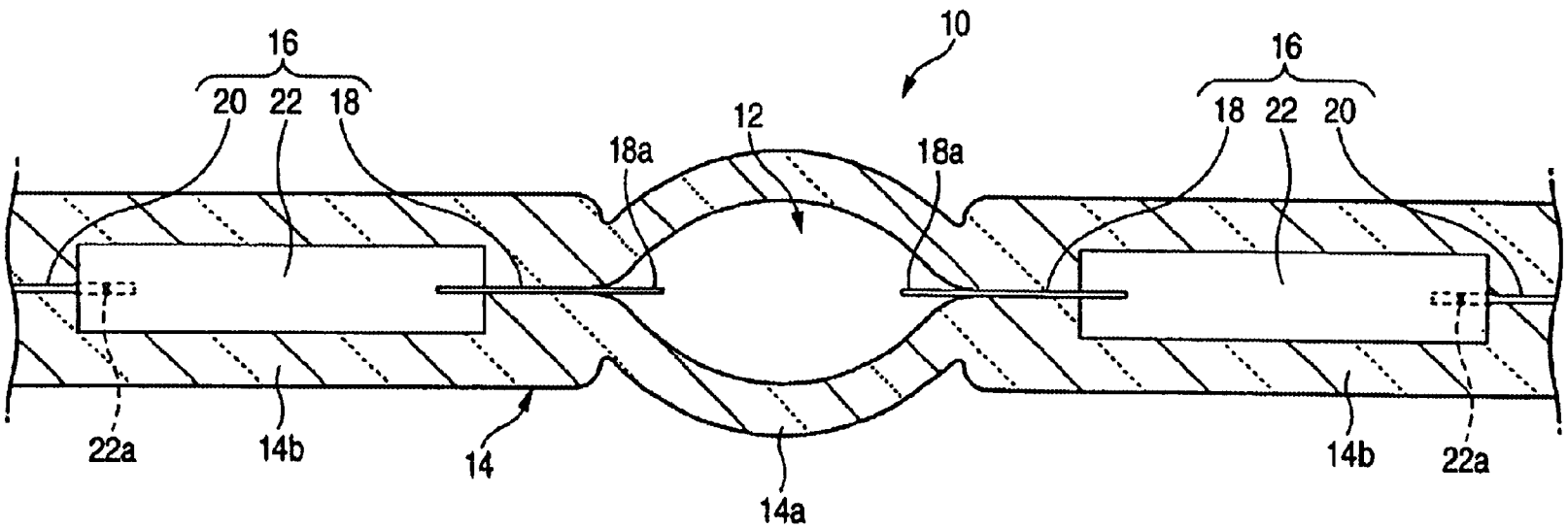
FIG. 2 is a perspective view showing main portions of the arc tube which is to be produced by the method of the embodiment.

FIG. 1 is a perspective view showing an electrode assembly inserting step in the method of producing an arc tube of an embodiment of the invention, and FIG. 2 is a side section view showing an arc tube 10 which is to be produced by the method.

As shown in FIG. 2, the arc tube 10 comprises: an arc tube body 14 which is made of quartz glass, and in which pinch seal portions 14*b* are formed on both sides of a light emitting tube portion 14*a* forming a discharge space 12; and a pair of electrode assemblies 16 which are pinch-sealed in the pinch seal portions 14*b* to the arc tube body 14.

In each of the electrode assemblies 16, a tungsten rod electrode 18 and a molybdenum lead wire 20 are connected to each other via a molybdenum metal foil 22 which is formed into a rectangular shape. The electrode assembly is pinch-sealed in a state where a tip end portion 18*a* of the rod electrode 18 is protruded into the discharge space 12. The rod electrode 18 has a diameter of about 0.25 mm and a length of about 6 mm, the lead wire 20 has a diameter of about 0.45 mm and a length of about 45 mm, and the metal foil 22 has a thickness of about 0.02 mm, a width of about 1.5 mm, and a length of about 7.2 mm. The rod electrode 18 is spot-welded to the surface of the metal foil 22, and the lead wire 20 is spot-welded to the rear face of the metal foil 22.

The electrode assembly insertion step shown in FIG. 1 is performed in advance of a second pinch seal step (a step of forming one of the pinch seal portions 14*b* on the quartz glass tube 2 in which the other pinch seal portion 14*b* is already formed) so that the electrode assembly 16 is inserted to a predetermined position in the quartz glass tube 2 starting from the tip end portion 18*a* of the rod electrode 18. In this step, the quartz glass tube 2 is vertically placed with directing the one pinch seal portion 14*b* downward, and in this state the electrode assembly 16 is inserted until the tip end portion 18*a* of the rod electrode 18 is protruded by a predetermined degree into the discharge space 12.

The degree of the insertion of the electrode assembly 16 into the quartz glass tube 2 is adjusted on the basis of position recognition data of the tip end portion 18*a* of the rod electrode 18 which are obtained by taking an image of the rod electrode 18 by a camera 50 that is placed in the lateral side of the quartz glass tube 2, and analyzing the image.

Figure 3:
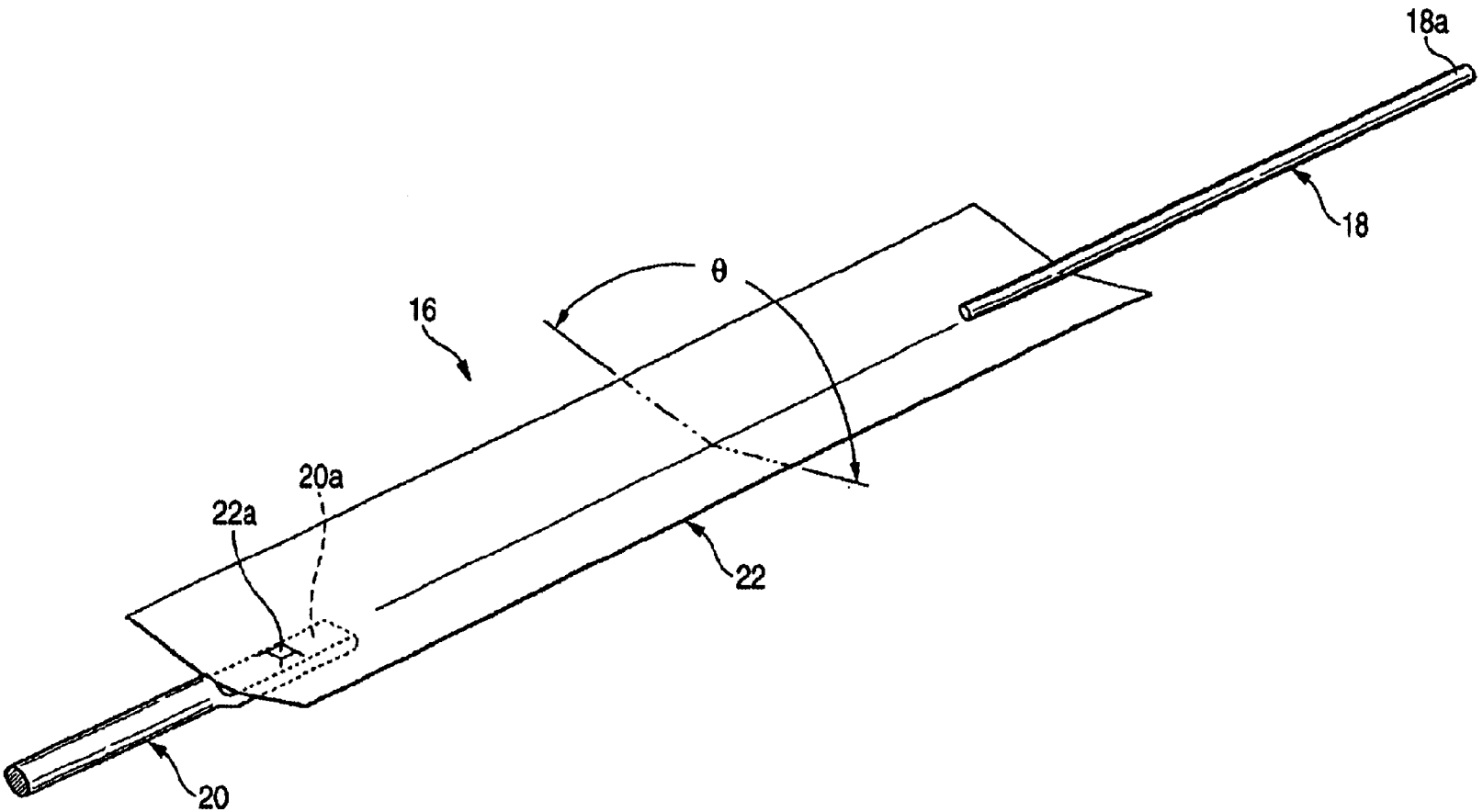
FIG. 3 is a perspective view showing only an electrode assembly which has not yet been inserted into a quartz glass tube in the embodiment.

FIG. 3 is a perspective view showing only the electrode assembly 16 which has not yet been inserted into the quartz glass tube 2.

As shown in the figure, in a step where the electrode assembly 16 has not yet been inserted into the quartz glass tube 2, the electrode assembly is in a state where a reinforcement bending process has been applied to the metal foil 22. The reinforcement bending process is performed by bending the metal foil 22 to form a section perpendicular to the longitudinal direction of the metal foil, into a substantially V-like shape. At this time, the central angle θ of the substantially V-like shape in the metal foil 22 is set to a value which is equal to or smaller than about 175° (for example, 165°).

The spot welding of the lead wire 20 and the metal foil 22 in the electrode assembly 16 is performed by projection welding. A weld mark 22*a* caused by the projection welding is formed in an end portion of the metal foil 22 so as to slightly rise.

Figure 4:
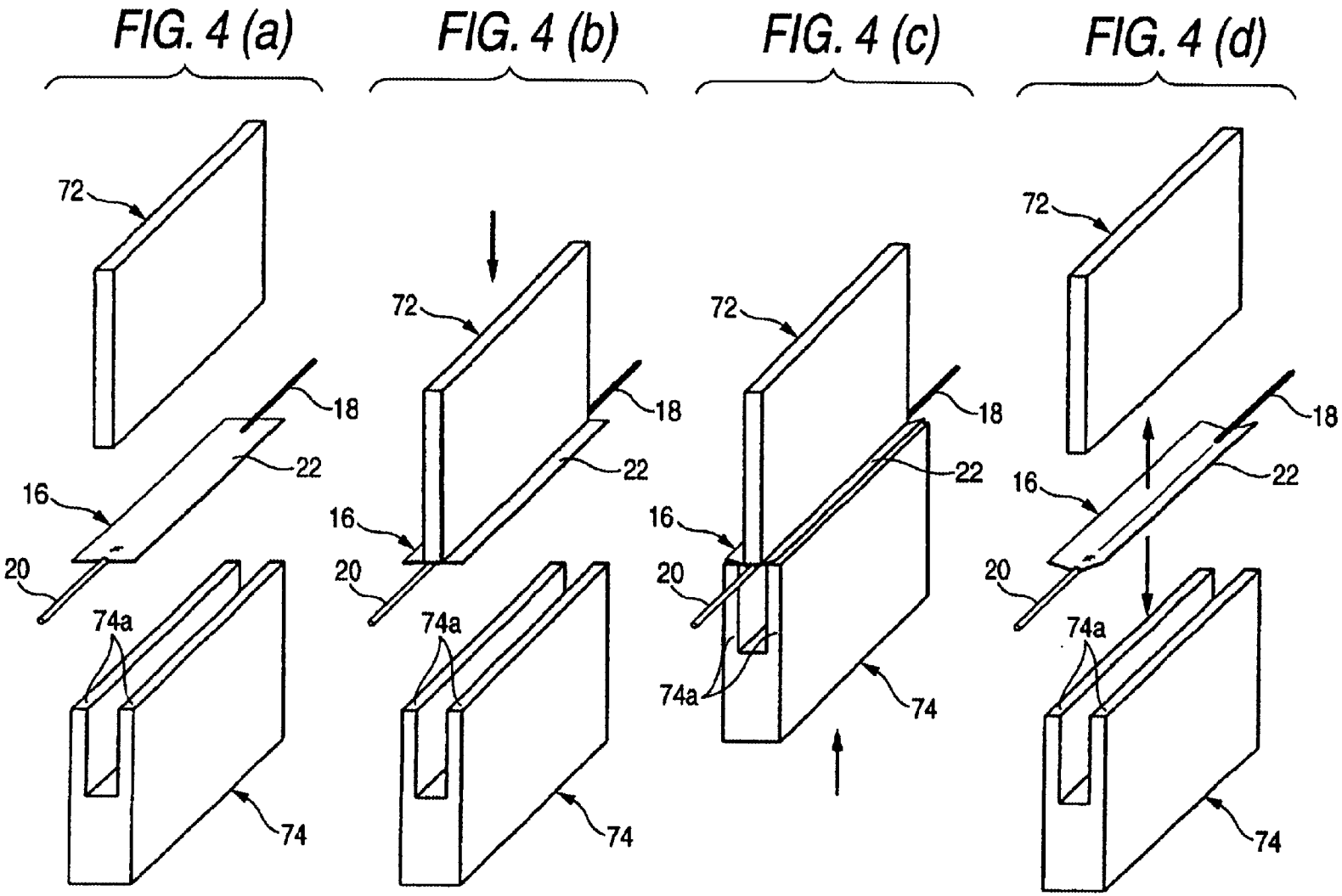
FIGS. 4(*a*)–4(*d*) are process flow diagrams showing a reinforcement bending process which is performed in the embodiment.

FIG. 4 is a process flow diagram showing the reinforcement bending process.

As shown in FIG. 4A, first, the electrode assembly 16 in which the metal foil 22 still has a flat shape is horizontally placed, a vertical plate-like punch 72 is placed above the assembly, and a receiving jig 74 in which a pair of pressing portions 74*a* are formed is placed below the assembly. As shown in FIG. 4B, then, the punch 72 is lowered to a position where the punch abuts against a center portion in the width direction of the metal foil 22 of the electrode assembly 16. As shown in FIG. 4C, the receiving jig 74 is raised so that the pressing portions 74*a* upward press the side portions in the width direction of the metal foil 22, whereby the metal foil 22 is bent to form a section perpendicular to the longitudinal direction into a substantially V-like shape. As shown in FIG. 4D, thereafter, the punch 72 is raised, the receiving jig 74 is lowered, and the electrode assembly 16 is extracted.

Figure 5:
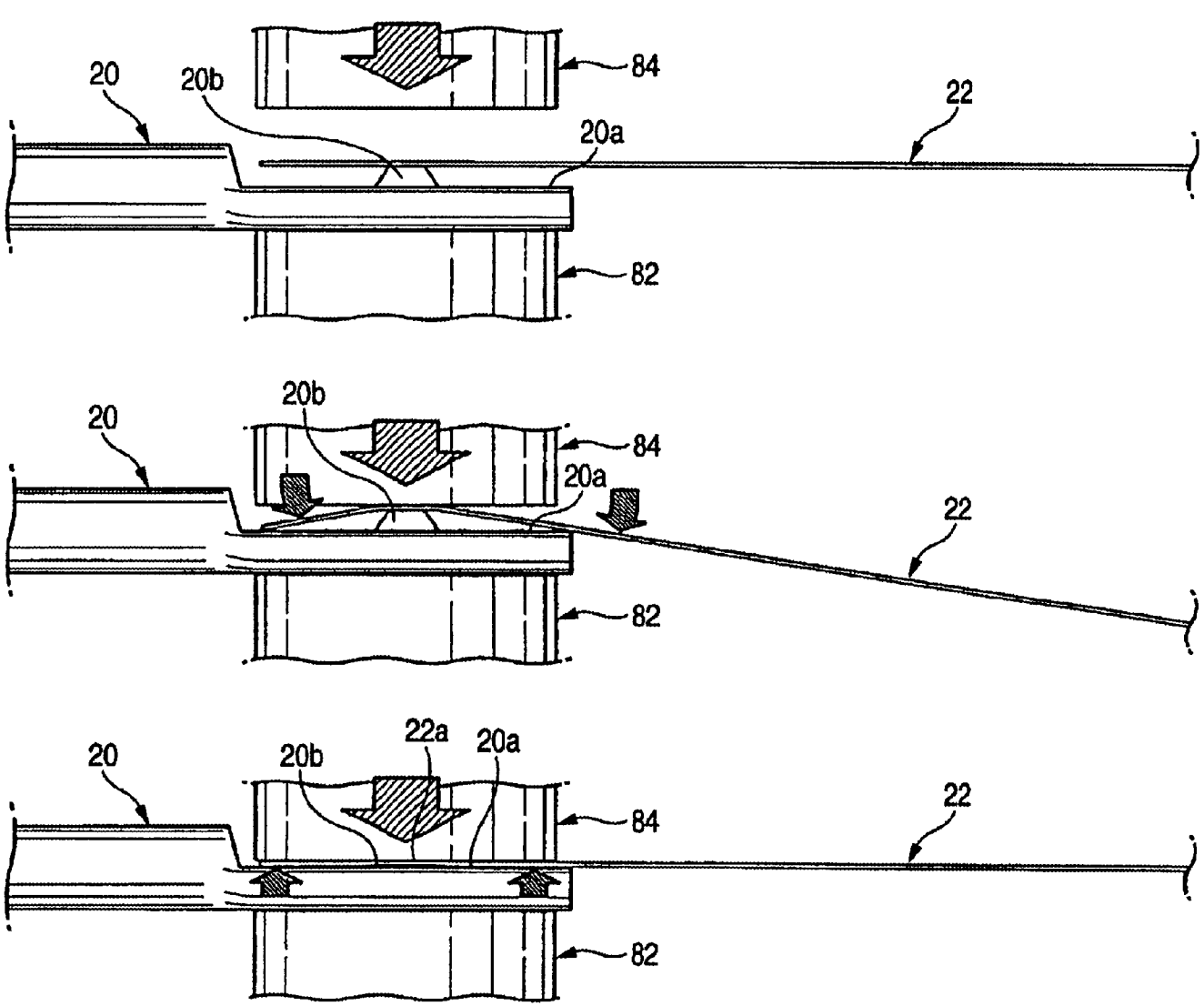
FIGS. 5(*a*)–5(*c*) are process flow diagrams showing a projection welding process which is performed in the embodiment.

FIG. 5 is a process flow diagram showing the projection welding.

As shown in FIG. 5A, previously, a flat face 20*a* is formed on a peripheral face of an end portion of the lead wire 20, and a projection 20*b* is formed at a substantially center position in the longitudinal direction of the flat face 20*a*. The specific dimensions are set in the following manner. For example, the length of the flat face 20*a* is about 1 mm, the width in the longitudinal direction of the projection 20*b* is about 0.3 mm, and the height of the projection 20*b* is about 0.1 mm. In a state where the end portion of the lead wire 20 is placed on a stationary electrode 82, the metal foil 22 is horizontally placed to straddle the projection 20*b* in the longitudinal direction.

As shown in FIG. 5B, then, a movable electrode 84 which is placed above the stationary electrode 82 is lowered to cause the metal foil 22 to be pressed against the projection 20*b*, and a current is supplied through the stationary electrode 82 and the movable electrode 84. At this time, the portions of the metal foil 22 which are respectively on both the sides of the projection 20*b* are once downward bent.

When the movable electrode 84 is further lowered, as shown in FIG. 5C, the projection 20*b* and the metal foil 22 are welded to each other while collapsing the projection 20*b*. At this time, the sides in the longitudinal direction of the metal foil 22 receive a reaction force from the flat face 20*a*. At a timing when the projection welding is completed, therefore, the bending of the metal foil 22 is corrected to produce a state where the lead wire 20 and the metal foil 22 extend in a substantially linear manner.

Also after the projection welding is completed, in the metal foil 22, the welded portion with the projection 20*b* is slightly raised as the weld mark 22*a* by the collapsed projection 20*b*.

As described above in detail, in the embodiment, the reinforcement bending process is applied to the metal foil 22 before the electrode assembly 16 is inserted into the quartz glass tube 2. Therefore, the embodiment can attain the following effects.

When the electrode assembly 16 is to be inserted into the quartz glass 2, the metal foil has a shape to which the reinforcement bending process has been applied, in place of a flat plate shape. Even when a vibration load acts on the electrode assembly 16, therefore, the metal foil 22 is not easily deformed, so that the rod electrode 18 can be prevented from largely swinging together with the metal foil 22. Consequently, the position of the tip end portion 18*a* of the rod electrode 18 can be easily recognized by using the camera 50, whereby the degree of the insertion of the electrode assembly 16 into the quartz glass tube 2 can be correctly adjusted.

According to the embodiment, therefore, in the step of inserting the electrode assembly 16 to the predetermined position in the quartz glass 2, a failure in the insertion of the electrode assembly 16 can be efficiently suppressed from occurring.

In the embodiment, particularly, the reinforcement bending process on the metal foil 22 is performed by bending the metal foil 22 to form a section perpendicular to the longitudinal direction of the metal foil, into a substantially V-like shape. Therefore, the reinforcement bending process can be performed by using the simple apparatus consisting of the punch 72 and the receiving jig 74.

In the embodiment, since the lead wire 20 and the metal foil 22 in the electrode assembly 16 are connected to each other by projection welding, it is possible to obtain sufficient weld strength. The projection welding is performed in the state where the flat face 20*a* is formed on a peripheral face of an end portion of the lead wire 20, the projection 20*b* is formed at an intermediate position in the longitudinal direction of the flat face 20*a*, and the metal foil 22 is placed to straddle the projection 20*b* in the longitudinal direction. Therefore, the embodiment can attain the following effects.

Figure 8:
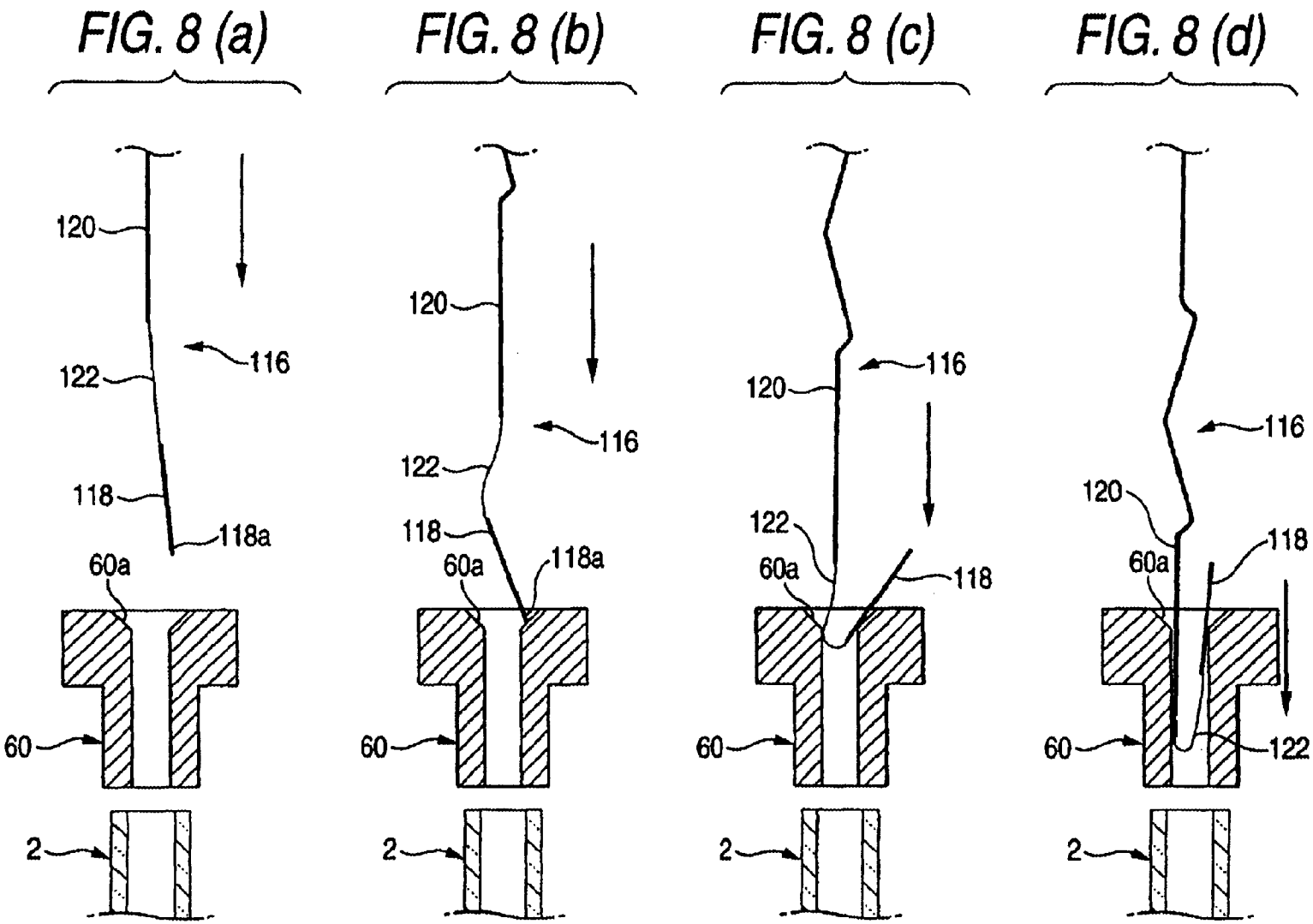
FIGS. 8(*a*)–8(*d*) are views showing the manner in which a failure occurs in the related art example.

In the middle of the projection welding, the metal foil 22 abuts against the projection 20*b* to be once bent in an end portion on the side of the lead wire 20. At a timing when the projection welding is completed, however, the bending of the metal foil 22 is corrected by the flat face 20*a* which is positioned on both the sides of the projection 20*b*, whereby the lead wire 20 and the metal foil 22 can be caused to extend in a substantially linear manner. When the electrode assembly 16 is inserted into the quartz glass 2, therefore, it is possible to prevent the tip end portion 18*a* of the rod electrode 18 from abutting against the opening end 60*a* (see FIG. 8) of the insertion guide pipe 60. As a result, in the electrode assembly inserting step, a failure in the insertion of the electrode assembly 16 can be more efficiently suppressed from occurring.

In the embodiment described above, the central angle θ of the substantially V-like shape in the metal foil 22 is set to a value which is equal to or smaller than about 175°. Even in the case where the angle is larger than 175°, when the metal foil 22 is bent at any degree from a flat plate shape, it is possible to suppress the metal foil 22 from being deformed when a vibration load acts on the electrode assembly 16.

Figure 6:
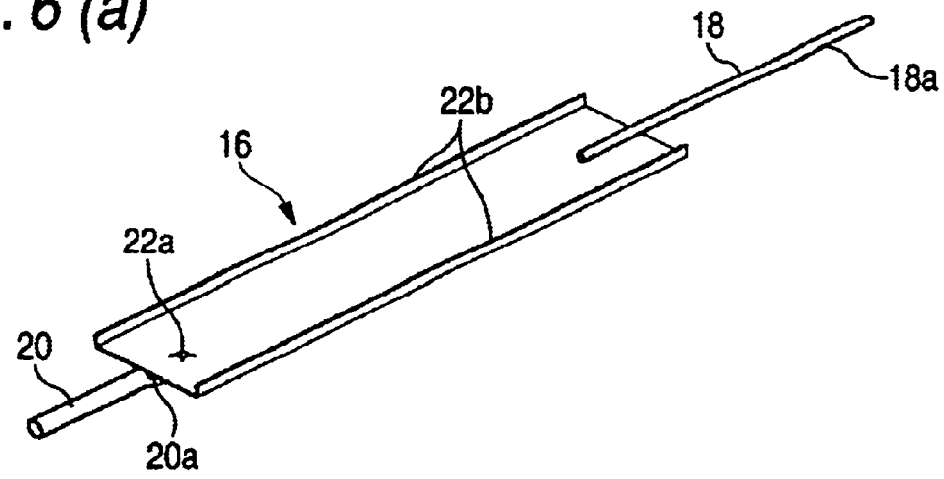
FIGS. 6(*a*)–6(*c*) are views similar to FIG. 3 and showing modifications of the electrode assembly which can be used in the embodiment.
Figure 6:
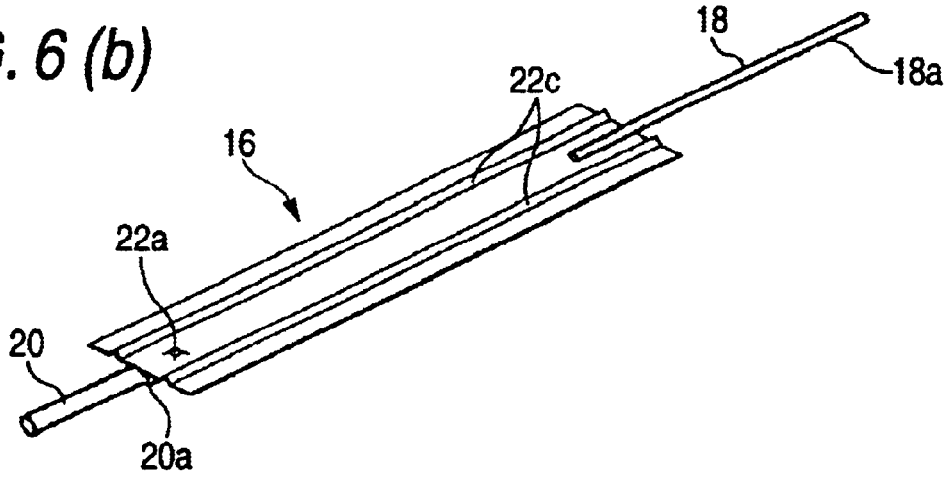
Figure 6:
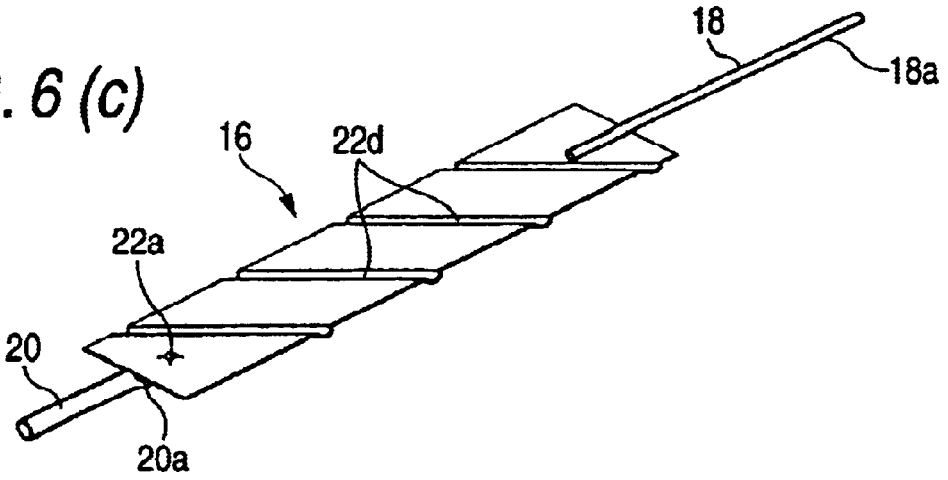
Figure 7:
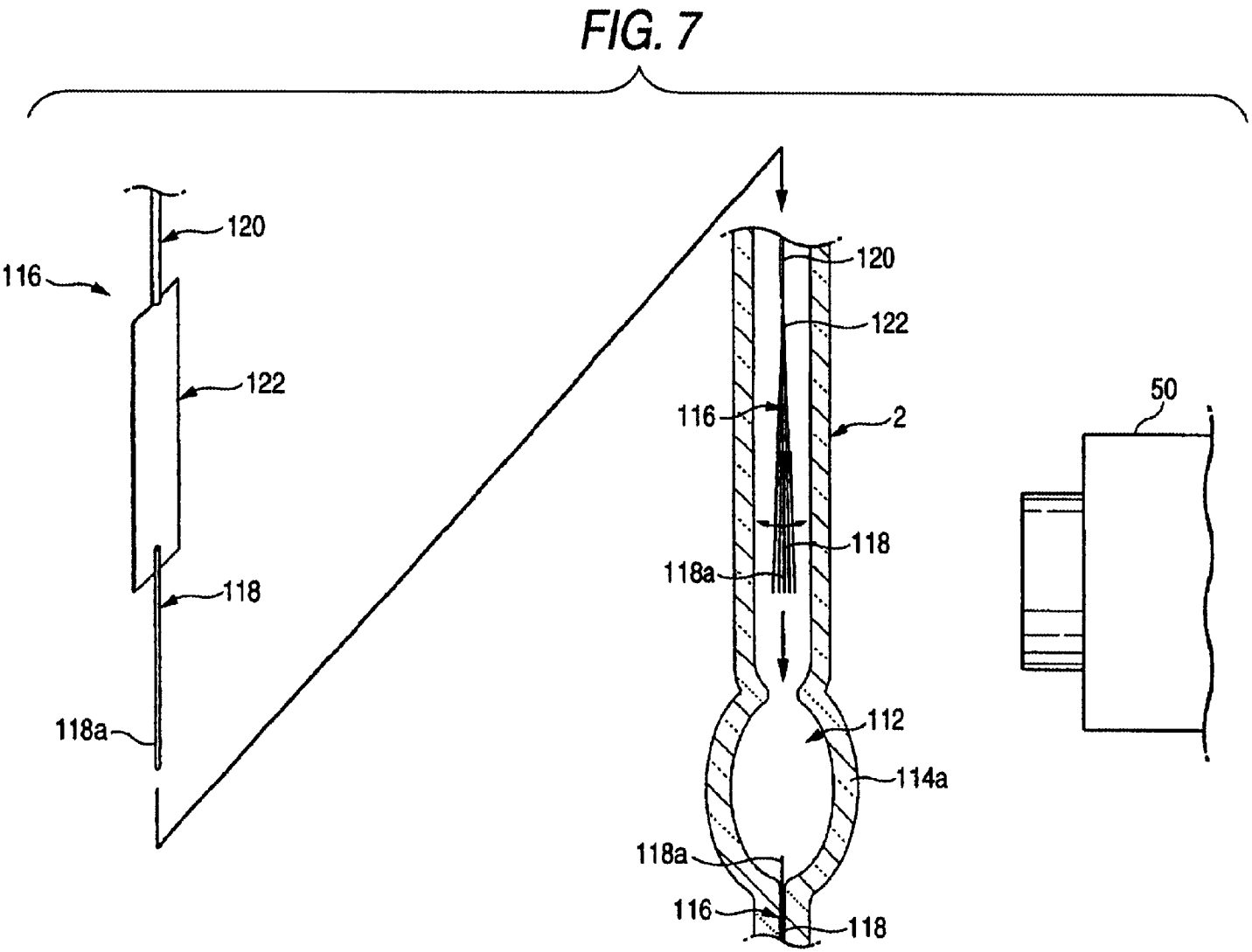
FIG. 7 is a view showing a related art example.

In the embodiment described above, the reinforcement bending process on the metal foil 22 is a process of bending the metal foil 22 to form a section perpendicular to the longitudinal direction of the metal foil, into a substantially V-like shape. The reinforcement bending process may be performed in a manner different from the above. For example, a flange portion 22*b* which is raised in an L-like shape may be formed in both the sides of the metal foil 22 as shown in FIG. 6A, a pair of beads 22*c* which extend in the longitudinal direction of the metal foil 22 may be formed on the metal foil as shown in FIG. 6B, or a plurality of beads 22*d* which extend obliquely with respect to the longitudinal direction of the metal foil 22 may be formed on the metal foil as shown in FIG. 6C.

In the embodiment described above, the electrode assembly 16 is inserted into the quartz glass tube 2 which is vertically placed, from the upper side of the tube. Also in other cases such as that where the electrode assembly 16 is inserted into the quartz glass tube 2 which is horizontally placed, when an arc tube is configured in the same manner as the embodiment, it is possible to attain the same effects as those of the embodiment.

In the embodiment described above, the electrode assembly insertion step is performed in advance of the second pinch seal step. Also in the case where the electrode assembly insertion step is performed in advance of a first pinch seal step, when the insertion into the quartz glass tube 2 is performed with using the electrode assembly 16 which is similar to that of the embodiment, it is possible to attain the same effects as those of the embodiment.

What is claimed is:

1. A method of producing an arc tube, comprising:

connecting a rod electrode and a lead wire via a foil to form an electrode assembly, and inserting said electrode assembly into a quartz glass tube after a reinforcement bending process is applied to said foil, wherein:

a flat face is formed in parallel to an axial direction of said lead wire at an end portion thereof; and said lead wire and said foil are connected to each other by performing a projection welding onto said flat face, with a projection being provided at an intermediate position in a longitudinal direction of said flat face where one side of said foil is placed to straddle said projection in the longitudinal direction, while said rod electrode is placed onto another side of said foil so as to secure an alignment in axial directions of said rod electrode and said lead wire.

2. A method of producing an arc tube according to claim 1, wherein said reinforcement bending process changes the shape of said foil to form a section perpendicular to a longitudinal direction of said foil, into a substantially V-like shape.

3. A method of producing an arc tube according to claim 1, wherein said reinforcement bending process changes the shape of said foil to form flanges on lateral sides of the foil.

4. A method of producing an arc tube according to claim 1, wherein said reinforcement bending process changes the shape of the foil to form longitudinal beads extending in the axial direction between the centerline and lateral edges of the foil.

5. A method of producing an arc tube according to claim 1, wherein the reinforcement bending process changes the shape of the foil by bending the lateral sides of the foil about a center axis of the foil so that first faces of the lateral sides form an angle less than 180 degrees.

6. A method of producing an arc tube according to claim 5, wherein the angle formed by the first faces of the lateral sides is less than or equal to 175 degrees.

7. A method of producing an arc tube according to claim 1, wherein said reinforcement bending process changes the shape of the foil to form oblique beads extending at an angle to the axial direction of the foil.

8. A method of producing an arc tube according to claim 1, wherein: the foil comprises first and second opposing surfaces and four lateral edges; the one side and the another side of the foil correspond to the first and second opposing surfaces; and the lead wire and rod electrode are arranged adjacent to an opposing pair of the four lateral edges.

* * * * *